United States Patent [19]

Murata et al.

[11] 4,421,575

[45] Dec. 20, 1983

[54] METHOD OF COOLING STEEL PIPES

[75] Inventors: Kyohei Murata, Kitakyushu; Heiji Morise, Fukuma; Yoichi Yazaki, Kitakyushu; Kazushi Maruyama, Kitakyushu; Haruyuki Nagayoshi, Kitakyushu; Etuji Kajiki, Kitakyushu, all of Japan

[73] Assignee: Nippon Steel Corporation, Tokyo, Japan

[21] Appl. No.: 223,924

[22] Filed: Jan. 9, 1981

[30] Foreign Application Priority Data

Jan. 16, 1980 [JP] Japan ..... 55-2588

[51] Int. Cl.[3] ..... C21D 9/08

[52] U.S. Cl. ..... 148/153; 148/143; 148/157

[58] Field of Search ..... 148/153, 157, 143

[56] References Cited

U.S. PATENT DOCUMENTS 4,149,913 4/1979 Kunioka ..... 148/153

OTHER PUBLICATIONS

*Physical Metallurgy Principles* second edition, Robert E. Reed-Hill Van Nostrand Co. N.Y. 1973, p. 733.

*Metals Handbook*, vol. 2 8th edition American Society for Metals, Metals Park, Ohio 1964, p. 56.

*Primary Examiner*—L. Dewayne Rutledge

*Assistant Examiner*—S. Kastler

*Attorney, Agent, or Firm*—Wenderoth, Lind & Ponack

[57] ABSTRACT

Quenched steel pipe is first held at a tempering temperature for a given period of time, then cooled relatively rapidly. While carrying the pipe in the direction of its length, cooling water is sprayed from outside onto its external surface at an average water flux of not lower than 0.05 $m^3/min.m^2$ and not higher than 2 $m^3/min.m^2$. This cooling is started when the pipe temperature is between 400° C. and 700° C. and ended between room temperature and 350° C. Also, the cooling is effected at a mean cooling rate of not lower than 5° C./sec. and not higher than 40° C./sec. This cooling method improves the collapse strength of a pipe by providing an appropriate tensile residual stress to the internal surface of the pipe and reduces the cooling floor area without sacrificing the collapse strength of the pipe.

3 Claims, 10 Drawing Figures

METHOD OF COOLING STEEL PIPES

BACKGROUND OF THE INVENTION

This invention relates to a method of cooling steel pipes that improves the cooling capacity of the cooling bed by the forced cooling of tempered pipes and/or enhances the collapse strength of pipes without increasing their tensile strength by said forced cooling.

Many quenching methods have been proposed for the heat treatment of steel pipes. Most of these methods comprise cooling steel pipes, first heated to above the $Ac_3$ transformation temperature (e.g. 850° C.), down to below approximately 100° C., by passing the pipes through one or more ring headers carrying many nozzles to spray cooling water. To reduce the addition of costly hardenability enhancing elements, these quenching methods call for such techniques as can assure extremely high cooling capacities (such as not lower than 35°–40° C./sec. in terms of the mean cooling rate at the inside pipe wall surface). For this purpose, various techniques have been proposed that involve such conditions as the average water flux of not less than 3 $m^3/min.m^2$ and the mean heat transfer coefficient of not less than 8000 $kcal/m^2.h.°C$. Here, the average water flux means the quantity of water supplied to the cooling zone divided by the external surface area of the pipe being cooled in the cooling zone. That is, the average water flux q ($m^3/min.m^2$) can be expressed as $q=Q/\pi DL$, in which D (m) is the outside diameter of the pipe, L (m) is the length of the cooling zone (or the part of the pipe which is exposed to the water), and Q ($m^3/min$) is the volume of water supplied. In other words, q represents the amount of cooling water sprayed per unit time onto unit area of the external surface of the pipe.

After being thus rapidly quenched, the pipe is reheated to between 500° and 700° C., at which temperature the pipe is held for a short time to provide what is known as tempering. Then, usually, the pipe is allowed to cool on the cooling bed down to the vicinity of 100° C. or room temperature very slowly, under the condition analogous to natural convection cooling. But this cooling of the tempered pipes on the cooling bed takes a long time, so that improvement of the cooling bed's capacity or development of a new, more efficient cooling method has come to be needed in order to cope with the recent increase in demand for high-quality heat-treated pipes.

Also, if the coolapse strength of pipe can be increased by giving properly selected cooling after tempering, such a method is favorable to the manufacture of oil-country tubular products and the like upon which great pressure is likely to be exerted.

Various methods of cooling heated pipes have been invented, but they have all been intended for other purposes than quenching. For example, Japanese Patent Publications Nos. 94415 of 1979 and 34667 of 1970 disclose methods to cool heated pipes from inside. Their object is to make the size of pipe steel crystal grains finer or enhance the corrosive resistance of pipe by relieving the internal pressure through the application of compressive residual stress on the inside of the pipe. So these methods cannot meet the aforesaid requirements. Japanese Patent Publication No. 80211 of 1979 discloses a method of cooling pipe from outside. This invention, like the present one, relates to a forced external cooling method, but is principally intended for crystal grain refinement like the foregoing two internal cooling methods.

SUMMARY OF THE INVENTION

An object of this invention, which has been made with the above-described background, is to provide a method of cooling tempered steel pipes that can be implemented within a short time on a cooling bed of an area which is not large.

Another object of this invention is to provide a method of cooling steel pipes that permits producing pipes wth high collapse strength by forcibly cooling the pipes after tempering.

To achieve the aforesaid objects, the cooling method according to this invention first holds quenched steel pipe at a tempering temperature for a given period of time, and then cools the pipe relatively faster than by the conventional method. To be more precise, cooling water is sprayed, at an average water flux of not less than 0.05 $m^3/min.m^2$ and not more than 2 $m^3/min.m^2$, onto the external surface of the pipe being conveyed in the direction of the longitudinal axis thereof. The cooling starts at a temperature between 400° C. and 700° C. and ends between room temperature and 350° C.

Such a forced rapid cooling permits reducing the area of the cooling bed and the cooling time.

The mean cooling rate according to this invention falls within the 5° C./sec. to 40° C./sec. range. When cooled at such a rate, circumferential tensile residual stress develops on the internal wall surface of the pipe, to such an extent as to enhance the collapse strength of the pipe.

BRIEF DESCRIPTION OF THE DRAWINGS

FIG. 3(*a*) shows an apparatus using flat spray nozzles, and FIG. 3(*b*) shows an apparatus with full cone spray nozzles.

DETAILED DESCRIPTION OF THE PREFERRED EMBODIMENTS

Figure 1:
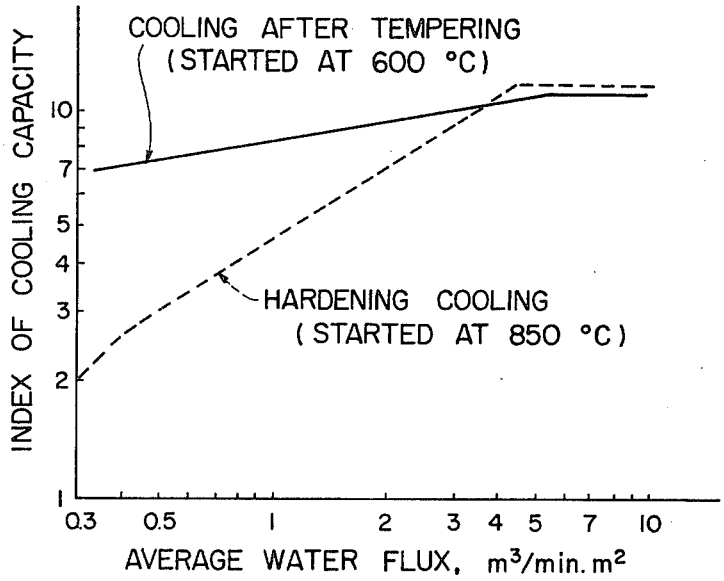
FIG. 1 shows an example of the characteristic of a cooling following tempering, compared with that of an ordinary quenching operation.

As stated previously, various quenching methods have been studied and proposed. But little has been reported as to the characteristics of cooling following tempering. Experimental, comparative studies made by the inventors have disclosed the characteristics of the cooling following tempering, as exemplified in FIG. 1 in comparison with the cooling for quenching. The characteristics found, which are summarized below, suggest the need for developing a new cooling technique. FIG. 1 graphically shows the relationship between the average water flux and the index of cooling capacity. The index of cooling capacity is proportional to the mean heat transfer coefficient, times the mean diameter of the coolant spray nozzles, divided by the thermal conductivity of the coolant.

The revealed characteristics are as follows:

(1) In the case of the quenching cooling, film boiling takes place first because cooling starts at high temperature (≧ approximately 850° C.), so that the heat transfer for the same water flux is more limited than in the after-tempering cooling.

(2) With the after-tempering cooling, nuclear boiling, which permits good heat transfer, is dominant because of the low starting temperature (between 400° C. and 700° C.). In other words, a high coefficient of heat transfer can be attained with a small quantity of water.

(3) In both cases, the heat transfer coefficient becomes almost saturated as the water flux reaches approximately 4 to 5 $m^3/min.m^2$. But in the after-tempering cooling, heat transfer is not so heavily affected by the water flux within the range of 0.5 to 4 $m^3/min.m^2$.

(4) Accordingly, the after-tempering cooling requires a high level of technique, especially in the control of cooling rate.

As seen from FIG. 1, the cooling capacity becomes saturated as the water flux reaches 4 to 5 $m^3/min.m^2$. In this connection, the inventors made experimental studies on the saving of water and pump motor power. The studies have shown that when cooling is started at a temperature between 400° C. and 700° C., it is sufficient, even if pipe wall thickness is great, to design the cooling apparatus and its auxiliary equipment so that a maximum water flux of 2 $m^3/min.m^2$ be secured. By so doing, it becomes practicable to provide forced cooling after tempering to increase the cooling capacity of the cooling bed (where air cooling has been done conventionally). This forced, controlled cooling following tempering provides a suitable amount of residual stress, which results in an increase in collapse strength.

It has been also found that the water flux of not more than 1 $m^3/min.m^2$ suffices when the forced, external post-tempering water cooling is applied to ordinary seamless or other pipes with a wall thickness of not greater than 25.4 mm, as an addition to or in substitution for the conventional air cooling on the cooling bed.

The lower limit of the average water flux is 0.05 $m^3/min.m^2$. To increase the collapse strength by imparting residual stresses, the amount of the cooling water sprayed should not be below this limit. If the average water flux does not reach this level, the cooling bed capacity cannot be increased either.

In an experiment made by the inventors, tempered steel pipes were passed through a warm sizing mill, provided immediately behind a tempering furnace, then cooled by the method of this invention. The resultant pipes were shaped better than those cooled by the conventional method, which is close to natural convection cooling, on the cooling bed, dispensing with the need for straightening and stress relief annealing (or relieving of the residual stress developed in the straightening process).

Figure 2:
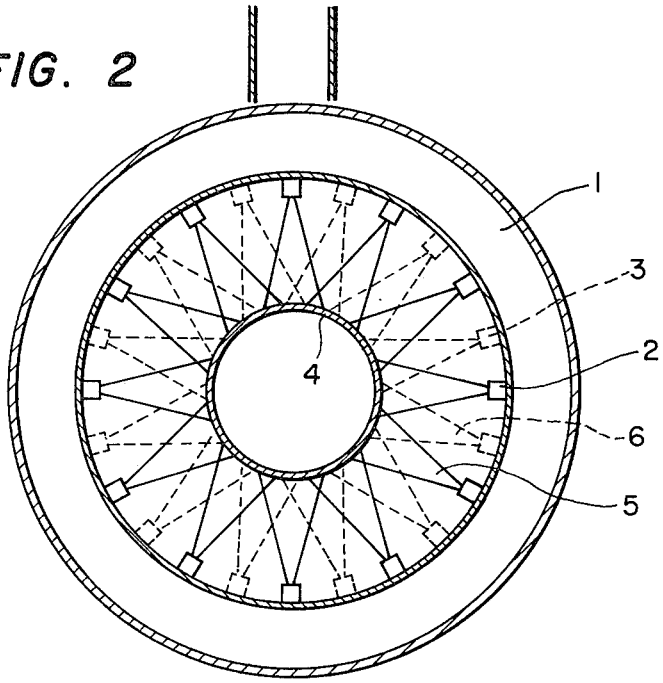
FIG. 2 is a front view showing a cooling header and the condition of cooling water ejected therefrom.

FIG. 2 shows a practical example of an apparatus for implementing the cooling method of this invention, which comprises one or more ring headers 3, disposed along the longitudinal axis of pipe 4, each header carrying a set of nozzles, indicated as 2 or 3, which are spaced at regular intervals but staggered relative to those on another header, along a circumference concentric to the pipe 4. The nozzles 2 on a front header and the cooling water 5 ejected therefrom are shown by solid lines, whereas the nozzles 3 on a rear header and the cooling water 6 therefrom by dotted lines. It is preferable to insert straightening vanes inside the header 1, through not shown in the figure.

From the nozzles, cooling water may be ejected in the form of either a screen or relatively large drops. Also, either water alone or an atomized mixture of water and air may be sprayed. Even in the case of the atomized air-water mixture, the cooling capacity is virtually determined by the average water flux.

Figure 3A:
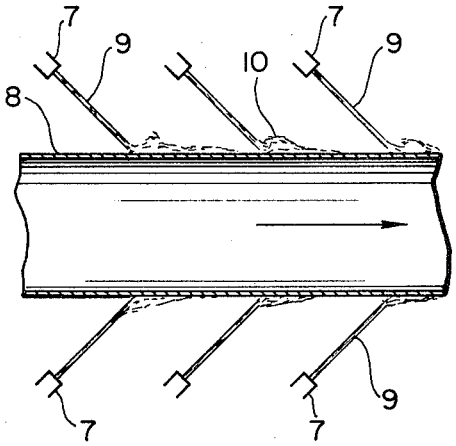
FIG. 3 comprises side elevations of a cooling apparatus showing different ejecting modes of cooling water.
Figure 3B:
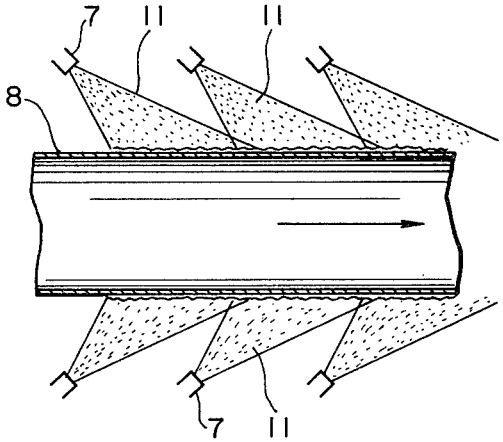

Whatever the ejecting form, this method assures a high cooling capacity because, as stated before, cooling starts at a temperature lower than in ordinary quenching cooling and nucleate boiling is dominant. Because the film of vapor is unstable, the ejecting pressure need not be higher than 3 $kg/cm^2G$, too. Any higher ejecting pressure means a waste of energy. FIGS. 3(*a*) and (*b*) are side elevations showing the ejecting conditions on the cooling apparatus. In FIG. 3(*a*), a flat nozzle 7 ejects a screen-like stream of cooling water 9 against a pipe 8 being cooled. After impinging on the pipe 8, the cooling water flows along the surfaces thereof as indicated by reference numeral 10. In FIG. 3(*b*), a full cone nozzle 7 sprays finely atomized drops of cooling water 11.

Figure 4:
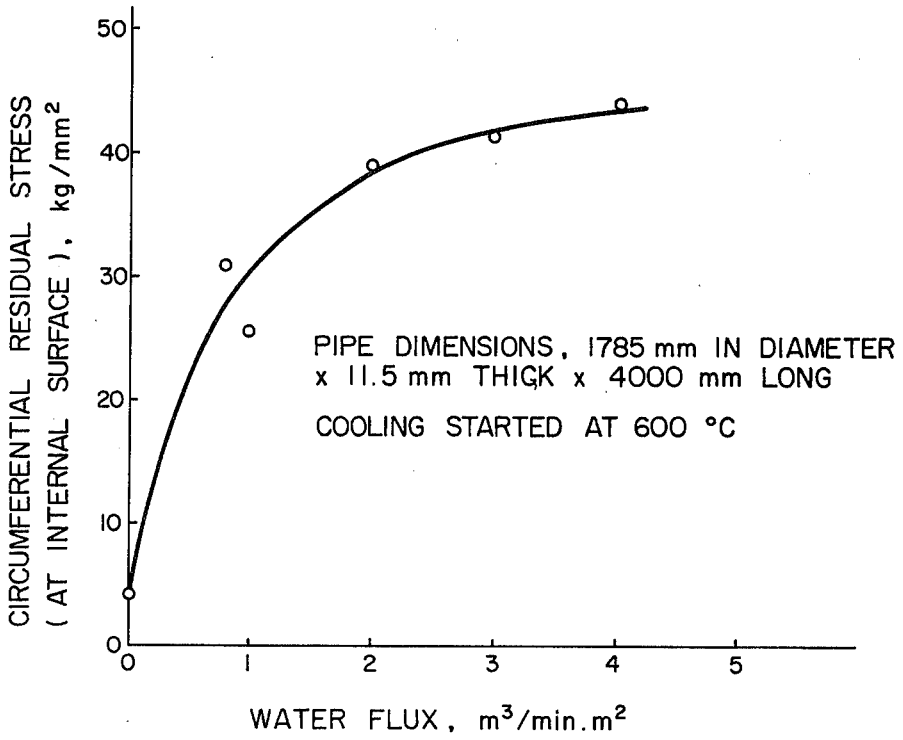
FIG. 4 graphically shows the magnitude of the residual stress resulting from the after-tempering cooling and the effects of the cooling conditions.

The inventors have also made extensive experimental studies on the effects of the forced post-tempering water cooling on the properties of heat-treated steel pipes. It has been found that the forced water cooling develops a circumferential tensile residual stress and compressive residual stress at the internal and external surface of the pipe, respectively, and that these stresses vary with the intensity of the cooling. A typical example is shown in FIG. 4. It has also been found that the residual stresses can be controlled by varying the cooling intensity, by taking advantage of the fact that the cooling capacity changes with the average water flux (or the mean heat transfer coefficient) as shown in FIG. 1.

In steel pipes allowed to cool slowly on the cooling bed, in a manner like cooling by natural convection, no greater residual stresses than approximately 5 kg/mm$^2$ develop. (Mostly they are tensile stresses, but in rare instances they can be compressive.) At any rate, such limited stresses exert practically no effect on the mechanical properties of the pipe.

When a tensile residual stress develops in the circumferential direction of a pipe, it has been found that the collapse strength of the pipe increases without increasing the strength of the steel itself. Such pipes with increased collapse strength are expected to be put into effective use in deep, high-pressure, highly corrosive oil wells being exploited in recent years and for other similar severe applications.

The inventors have made many studies and experiments as to the application of the after-tempering cooling method of this invention for the manufacture of steel pipes having high corrosion resistance and high collapse strength. It has been found that excess cooling following tempering develops a great tensile residual stress along the circumference of the internal surface. At the same time, however, a great compressive stress remains at the external surface. Consequently, collapse strength of the whole pipe is not increased.

As a result of continual studies, the inventors have found that the collapse strength of the entire pipe can be increased by holding the mean cooling rate at the internal surface of the pipe (between the temperature at which water cooling, including one with the atomized mixture of water and air, beings and 350° C.) from 5° to 40° C./sec. and controlling the temperature at which the cooling ends.

Figure 5:
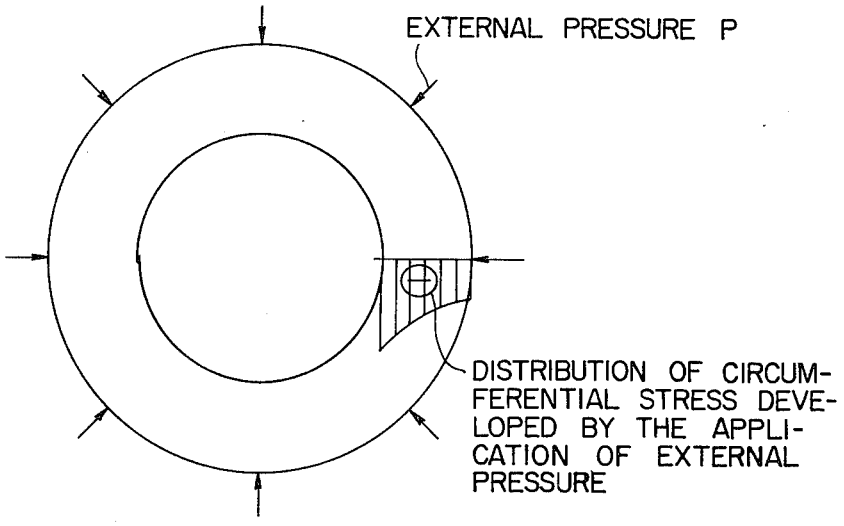
FIG. 5 shows the distribution of stress that develops upon the application of external pressure on a pipe; the circumferential compressive stress increasing from outside to inside across the wall thickness of the pipe.

On applying external pressure on a steel pipe, a circumferential compressive stress develops as shown in FIG. 5. This compressive stress is greater on the internal surface side than on the external surface side, the difference increasing with an increase in pipe wall thickness.

Figure 6:
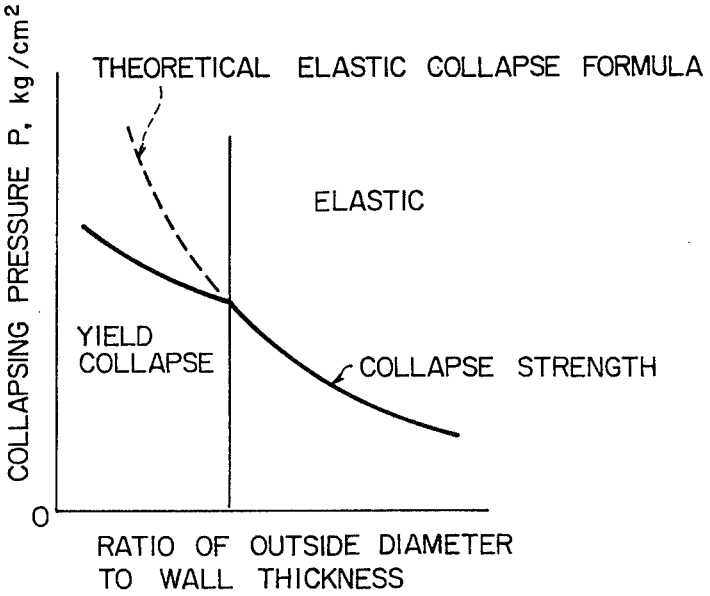
FIG. 6 shows the relationship between the ratio of outside diameter to thickness of steel pipe with constant strength and the intensity of collapse pressure, the outside diameter-to-thickness ratio being plotted as the abscissa and the collapse pressure ($kg/cm^2$) as the ordinate.

Collapse means a phenomenon in which pipe buckles under external pressure. To be more precise, there are two collapse regions; an elastic collapse region and a yield collapse region, as shown in FIG. 6. In the elastic collapse region, buckling takes place before the material steel yields under the combined effect of the ratio of pipe wall thickness to the outside diameter and the yield strength of the material steel. In the yield collapse region, buckling takes place after the yielding. In the latter region, yielding progresses from the internal surface toward the external surface, the resistance to deformation in the affected zone growing remarkably low. Therefore, the stiffness of the entire pipe against external pressure too drops, leading to a collapse.

Figure 7:
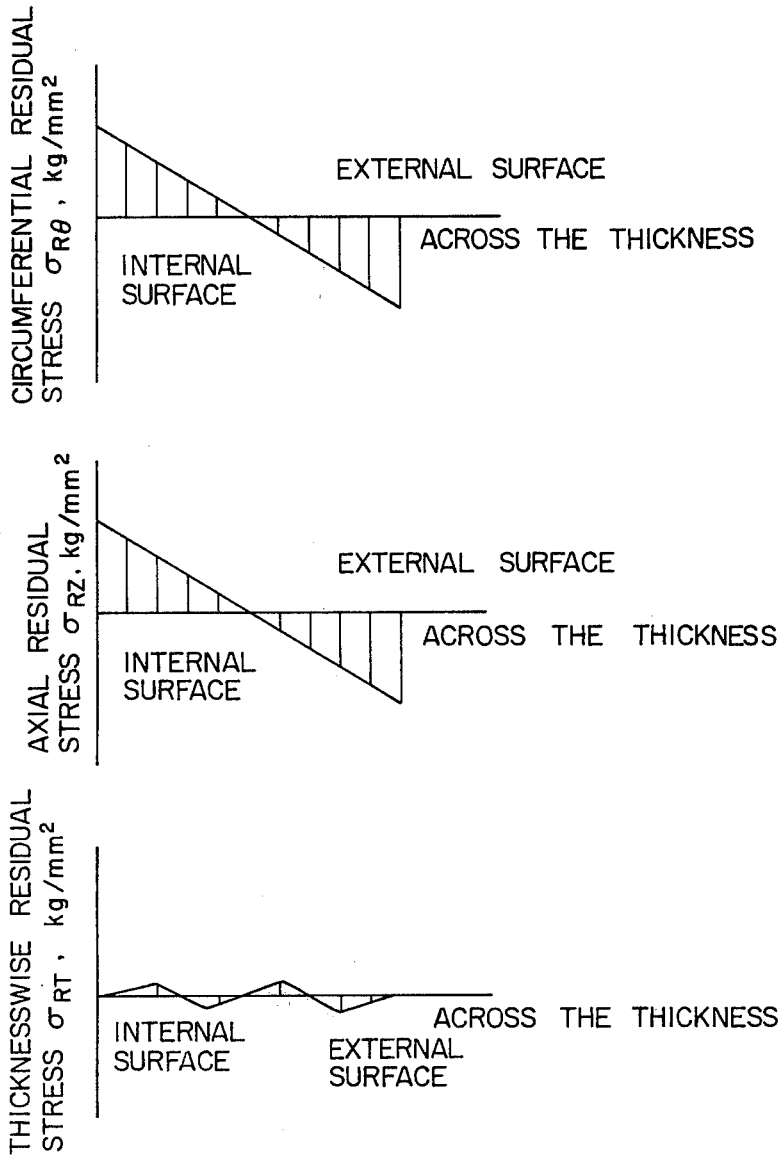
FIG. 7 shows the distributions of residual stress developed inside a pipe by the controlled external cooling method according to this invention; a graph at the top, middle and bottom shows the circumferential, axial and thicknesswise distribution of residual stress ($kg/mm^2$), respectively. In the three figures, the pipe wall thickness is plotted as the abscissa and the residual stress in the circumferential and axial directions and across the thickness as the ordinate.

The method of this invention can be utilized for increasing the collapse strength in the yield collapse region. When, following tempering, water or a mixture of water and air is sprayed from the outside, tensile and compressive residual stresses develops on the internal and external surface of the pipe, respectively, as shown in FIG. 7. This combination of the stresses increases the yield strength of the pipe against external pressure. As a consequence, the same pipe attains greater rigidity to withstand higher external pressure, thus gaining higher collapse strength than that of residual-stress-free pipes.

As will be discussed later, the residual stresses can increase the yield strength against external pressure only with a certain limited range. In this connection, the method of this invention has a major asset of being able to control the residual stresses as desired.

The following paragraphs describe the range, and effects, of the residual stresses in which the external, controlled water cooling of this invention can produce high collapse strength.

Figure 8:
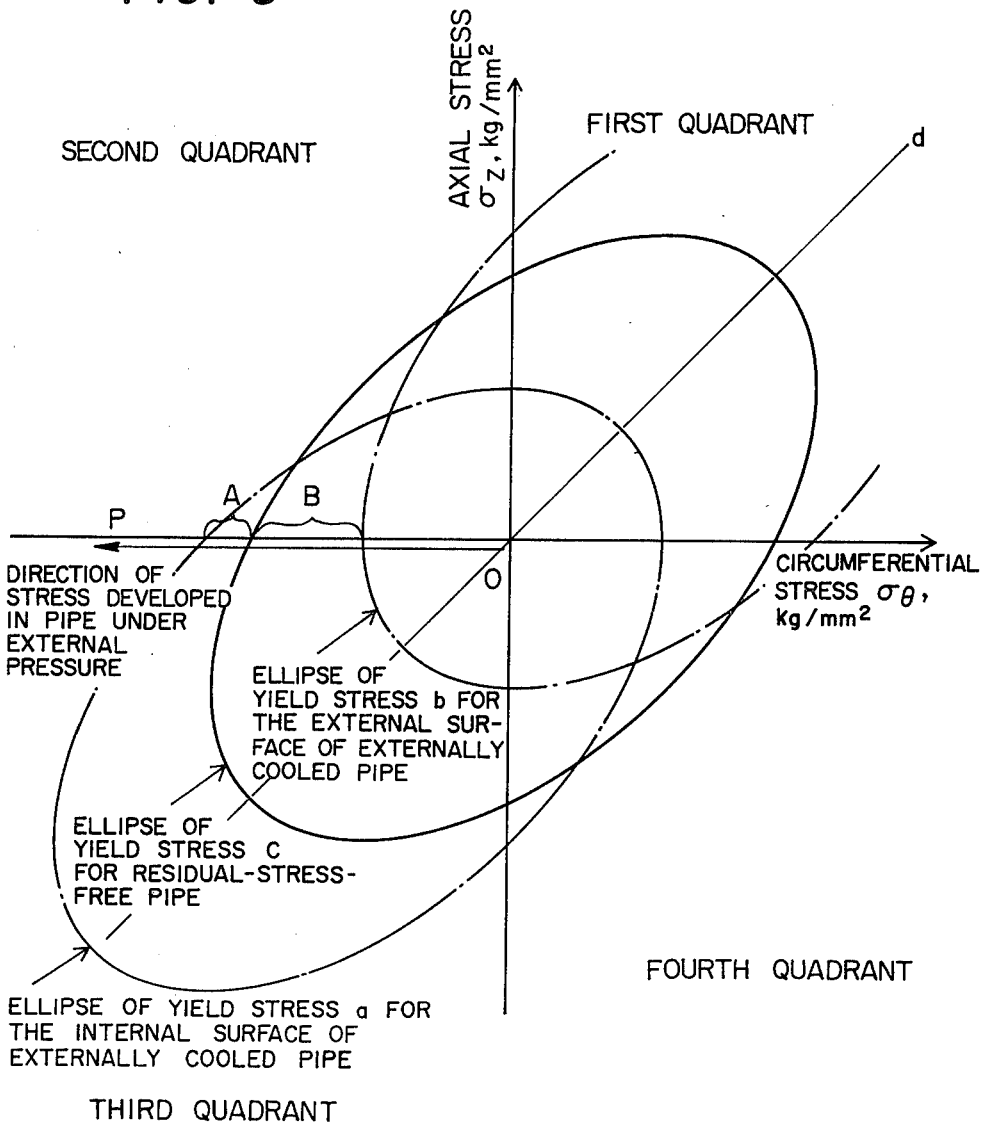
FIG. 8 shows the Mises' ellipse of yield stress for a residual-stress-free pipe and the ones for the vicinity of the internal and external surfaces of a pipe subjected to the controlled external cooling according to this invention. The circumferential applied stress is plotted as the abscissa and the axial applied stress as the ordinate (both in $kg/mm^2$).

The residual stress distribution resulting from the external water cooling (FIG. 7) exhibits two characteristics; one being that both tensile residual stress at the internal surface and compressive residual stress at the external surface change linearly across the thickness of pipe; the other being that the residual stresses in the circumferential and axial directions are substantially equal in magnitude and pattern. In addition, there is practically no residual stress extending in the direction of thickness. Therefore, the yield condition of the material steel can be considered on the basis of Meses' ellipse of biaxial yield stress. FIG. 8 compares Mises' ellipses of yield stress for a tempered steel pipe subjected to external cooling with the one for an as-tempered residual-stress-free steel pipe.

Figure 9:
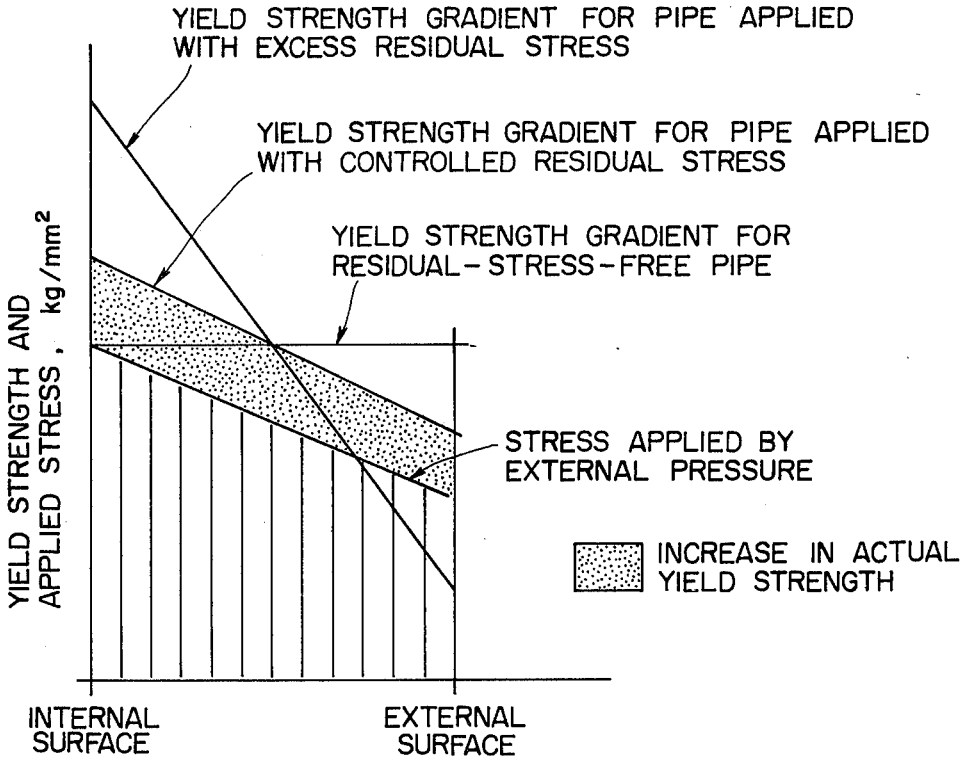
FIG. 9 shows the relationship between the apparent yield strength attained by the controlled external cooling according to this invention and the stress produced by the external pressure at different parts across the pipe wall thickness. The pipe wall thickness is plotted as the abscissa and the yield strength or applied stress as the ordinate.

When the axial and circumferential residual stresses are equal, as with the external cooling according to this invention, the center of the yield ellipse moves along a line d that bisects the first and third quadrants of FIG. 8. If, for example, there is a tensile residual stress of 10 kg/mm$^2$ at the internal surface of a pipe, the center of the yield ellipse for this part can be expressed by the coordinates (−10, −10). By moving a yield ellipse c for a residual-stress-free pipe along the longer axis thereof in the direction of the third quadrant by the amount equal to $\sqrt{2}$ times greater residual stress, a yield ellipse a for a pipe having axial and circumferential tensile residual stresses is obtained. Likewise, by moving the same yield ellipse c in the opposite direction, or toward the first quadrant, by the same amount, a yield ellipse b for a pipe with axial and circumferential compressive residual stresses is obtained. In the pipe upon which external pressure is exerted, stress develops in the direction of the arrow (OP). Accordingly, the yield strength of the externally cooled pipe increases on the internal surface side by the amount A, but decreases on the external surface side by the amount B. Apparently, thus, it seems that the decrease offsets the increase, providing no advantage at all. Actually, however, the circumferential compressive stress induced by the external pressure is greater on the inside than on the outside. Therefore, as shown in FIG. 9, the negative effect of the residual stress on the outside can be compensated for by the distribution of applied stress. But if any great residual stress is developed as a result of excess cooling, the yield strength drops even below the level of the residual-stress-free pipes. This means that the residual stress should be kept within a certain appropriate range that varies with the ratio of the pipe outside diameter to the pipe thickness. For the oil country tubular products in current use, the appropriate residual stress falls within the range of 10 kg/mm$^2$ to 15 kg/mm$^2$.

To obtain such appropriate residual stress, the mean cooling rate should preferably fall within the following range. When the mean cooling rate is not higher than 5° C./sec., the resulting residual stress is too small. When the rate exceeds 40° C./sec., the residual stress becomes too great. In either case, the collapse strength of the whole pipe does not increase. The appropriate cooling rate and the cooling ending temperature depends upon the mean cooling rate, the chemical composition and the dimensions of the pipe, and other factors. Meanwhile, it should be ensured that the residual stress is not changed by the stress relief annealing provided in the air-cooling process following the forced water-cooling, and also that the pipe is not deformed because of any partial temperature differential occurring during the air-cooling. All things considered, the upper limit of the cooling ending temperature has been empirically set at 350° C.

The controlled cooling according to this method is applied behind a tempering furnace or, where a warm sizing mill is provided between a tempering furnace and a cooling bed, preferably behind the sizing mill. In the experiments made by the inventors, however, the distribution and magnitude of residual stresses on the pipes differed little even when the same controlled cooling was applied between the tempering furnace and sizing mill, so far as the fractional reduction in the pipe outside diameter on the sizing mill remained as low as 2 to 3 percent. Experiments were also made on the application of the same controlled cooling within the sizing mill. But it was very difficult to control the cooling operation and, therefore, the residual stresses.

Any straightening following the controlled cooling may possibly cause the residual stress distribution in the pipe to change. For instance, the circumferential tensile residual stress at the internal surface may be changed to compressive. So, straightening, especially a major one, should be avoided. With straightening thus narrowly limited or practically prohibited, special care should be exercised to prevent the occurrence of irregular wall thickness distribution in the heating, rolling and forming processes and irregular temperature distribution in the tempering furnace etc., and to provide a uniform controlled cooling so that no shape irregularities result.

It has been confirmed that the cooling apparatus and auxiliary equipment ensuring a maximum average water flux of 2 $m^3/min.m^2$ is enough also for the controlled cooling given after tempering.

The experiments on the uniform controlled cooling have shown that the atomized spray of water alone or a water-air mixture from a full cone or other similar nozzles offers higher uniformity and cooling effect controllability than the spray in screen or drop form given through flat or other similar nozzles.

Because the film of vapor is unstable and the water flux small, the water flux strongly governs the capacity of the controlled cooling method according to this invention. Therefore, the ejecting pressure of the cooling water need not be very high. So the cooling apparatus should be designed so that a maximum ejecting pressure, which, of course, depends on nozzle type and ejecting mode, of 3 $kg/cm^2G$ is secured.

The following paragraphs describe an example of the manufacture of a high collapse strength steel pipes according to the method of this invention.

Quenched specimen pipes were held at a tempering temperature for 30 minutes, and then cooled under a variety of conditions using an external cooling apparatus placed on the exit side of a tempering furnace. The water cooling nozzles used were of the full cone type shown in FIG. 3(*b*). Table 1 shows the dimensions, strength (API proof stress) and chemical composition of the specimen pipes. Table 2 shows the cooling conditions, residual stresses and collapse strengths for the specimen pipes cooled under varying conditions and those subjected to roller straightening after cooling.

TABLE 1

| Dimensions, Strength and Chemical Composition of Specimen Pipes | | | | | | | | | |
|---|---|---|---|---|---|---|---|---|---|
| Dimensions | | Strength | Chemical Composition (%) | | | | | | |
| Outside Diameter | Wall Thickness | (API Proof Stress) | C | Si | Mn | P | S | Ti | B |
| 178.0 mm | 10.4 mm | 60–64 $kg/mm^2$ | 0.18 | 0.27 | 1.50 | 0.015 | 0.012 | 0.038 | 0.0012 |

TABLE 2

| Cooling Conditions, Residual Stresses and Collapse Strengths | | | | | | | | | |
|---|---|---|---|---|---|---|---|---|---|
| | | External Cooling Conditions | | | | | Pipe Properties | | |
| Specimen No. | | Average Water Flux ($m^3/min.m^2$) | Cooling Starting Temperature (°C.) | Ejecting Pressure ($kg/cm^2G$) | Mean* Cooling Rate (°C./sec) | Cooling Ending Temperature (°C.) | Internal Circumferential Residual Stress ($kg/mm^2$) | Collapse Strength ($kg/cm^2$) | Collapse Strength Ratio |
| 1 | Air-cooled after tempering | — | 670 | — | — | — | 0 | 654 | 1 |
| 2 | Externally | 0.150 | " | 0.5 | 20.0 | 365 | 5 | 713 | 1.09 |
| 3 | water- | 0.194 | " | " | 24.4 | 286 | 11 | 759 | 1.16 |
| 4 | cooled | " | " | " | 25.3 | 315 | 13 | 706 | 1.08 |
| 5 | after | " | " | " | 25.8 | 343 | 14 | 759 | 1.16 |
| 6 | tempering | 0.312 | " | " | 30.2 | 256 | 21 | 680 | 1.04 |
| 7 | | " | " | " | 29.8 | 212 | 23 | 667 | 1.02 |
| 8 | | 0.453 | " | " | 43.6 | 175 | 28 | 556 | 0.85 |
| 9 | | " | " | " | 42.8 | 143 | 31 | 582 | 0.89 |
| 10 | | " | " | " | 42.2 | 102 | 32 | 517 | 0.79 |
| 11 | Externally | 0.194 | " | " | 24.2 | 277 | −5 | 602 | 0.92 |
| 12 | water-cooled | " | " | " | 24.8 | 309 | −9 | 562 | 0.86 |
| 13 | after temper- | " | " | " | 25.4 | 338 | −11 | 549 | 0.84 |
| 14 | ing, followed | 0.388 | " | " | 32.2 | 109 | −11 | 504 | 0.77 |
| 15 | by roller straighten- | " | " | " | 33.0 | 133 | −11.5 | 543 | 0.83 |

TABLE 2-continued

| Specimen No. | Cooling Conditions, Residual Stresses and Collapse Strengths: External Cooling Conditions: Average Water Flux ($m^3/min.m^2$) | Cooling Starting Temperature (°C.) | Ejecting Pressure ($kg/cm^2G$) | Mean* Cooling Rate (°C./sec) | Cooling Ending Temperature (°C.) | Pipe Properties: Internal Circumferential Residual Stress ($kg/mm^2$) | Collapse Strength ($kg/cm^2$) | Collapse Strength Ratio |
|---|---|---|---|---|---|---|---|---|
| ing | | | | | | | | |

*Mean cooling rate from 650° C. (at internal surface).

The collapse strength ratio in the rightmost column is the value compared with the base figure (1) for the residual-stress-free pipe, representing the effects of the residual stress applied. The specimen No. 1 was cooled by the conventional method, while specimen Nos. 2 through 10 were cooled by the method of this invention. The specimen Nos. 11 through 15 were subjected to roller straightening for the purpose of comparison.

Figure 10:
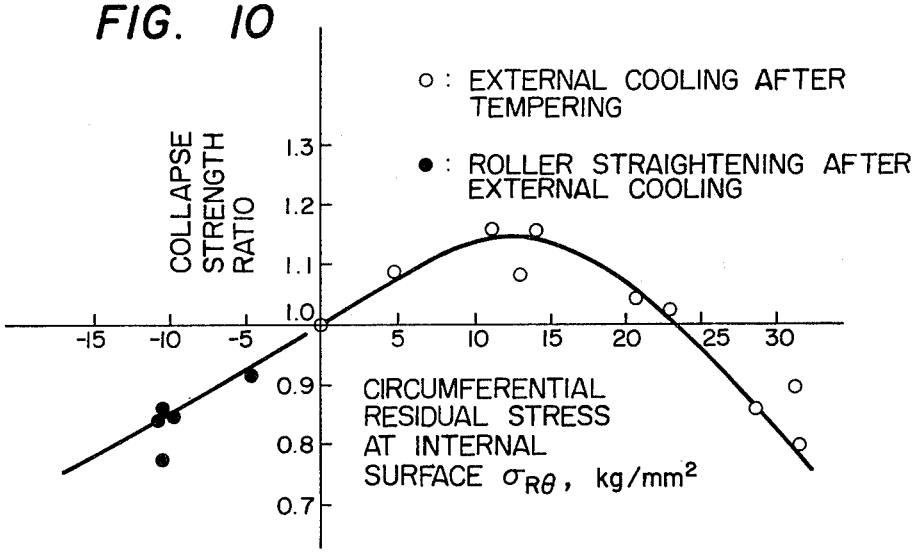
FIG. 10 shows the relationship between the circumferential residual stress at the internal surface and the collapse strength. The circumferential residual stress at the internal surface ($kg/mm^2$) is plotted as the abscissa and the ratios of the collapse strength of pipes applied with varying residual stresses to that of a residual-stress-free pipe as the ordinate.

FIG. 10 shows the relationship between the collapse strength ratio and residual stress. As seen, the collapse strength reaches the peak when the circumferential tensile residual stress at the internal surface is between 10 and 15 $kg/mm^2$.

The cooling method of this invention is effective on steel pipes whose thickness-to-outside-diameter ratio ranges between approximately 12 and 30, especially between 15 and 25. So it is widely applicable to oil-country tubular products, line pipes and the like. Also, the steels to which this method is applicable are tempered ones, such as those quenched and tempered, or normalized and tempered.

What is claimed is:

1. In a method of cooling a hardened steel pipe after holding the pipe at a tempering temperature for a given period of time, the improvement which comprises the steps of:

spraying cooling water from outside onto the external surface of the pipe which is being conveyed in the direction of the longitudinal axis thereof, said water being sprayed at a rate of not lower than 0.05 $m^3/min.m^2$ and not higher than 2 $m^3/min.m^2$;

starting the cooling at a pipe temperature between 400° C. and 700° C.; and continuing the cooling at a rate of not lower than 5° C./sec and not higher than 40° C./sec until the pipe temperature drops to between room temperature and 350° C., thereby causing an appropriate amount of circumferential residual tensile stress to arise at the inside surface thereof to enhance the collapse strength of the pipe.

2. The improvement according to claim 1 wherein the steel pipe has an outside diameter to wall thickness ratio of between about 12 and 30.

3. The improvement according to claim 2 wherein the steel pipe has an outside diameter to wall thickness ratio of between about 15 and 25.

* * * * *